United States Patent [19]

Vagias

[11] 4,346,639

[45] Aug. 31, 1982

[54] THERMOPLASTIC KEY FACE FOR PIANOS OR THE LIKE

[75] Inventor: Alex M. Vagias, Baden, Pa.

[73] Assignee: Ernest Vagias, Baden, Pa.

[21] Appl. No.: 287,432

[22] Filed: Jul. 27, 1981

[51] Int. Cl.[3] ..... G10C 3/12

[52] U.S. Cl. ..... 84/437; 84/452 P

[58] Field of Search ..... 84/433, 437, 452 P

[56] References Cited

U.S. PATENT DOCUMENTS

| | | | |
|---|---|---|---|
| 3,032,455 | 5/1962 | Fauser | 84/437 |
| 3,187,619 | 6/1965 | Andersen | 84/437 |
| 3,330,176 | 7/1967 | Schwartz et al. | 84/433 |
| 3,417,649 | 12/1968 | Wood | 84/433 |
| 3,561,315 | 2/1971 | Ohno | 84/433 |
| 3,855,894 | 12/1974 | Thomas et al. | 84/423 |
| 4,205,583 | 6/1980 | Absmann | 84/433 |

*Primary Examiner*—Lawrence R. Franklin

*Attorney, Agent, or Firm*—Thomas H. Murray; Clifford A. Poff

[57] ABSTRACT

A key cover plate for a piano or the like is injection-molded thermoplastic material marbleized by incomplete mixing of a color agent. The cover plate simulates the grain of natural ivory and has a Munsell hue of between 4.5Y to 8.8Y to 6.6YR. The cover plate also has a Munsell chroma of between 1.0 to 2.6 and a Munsell value of between 8.3 to 9.3. A contrast ratio of the plastic ivory material is between 70 to 90.

7 Claims, 7 Drawing Figures

THERMOPLASTIC KEY FACE FOR PIANOS OR THE LIKE

BACKGROUND OF THE INVENTION

This invention relates to a thermoplastic key cover or similar article of manufacture for attachment to a key of a piano or the like. More particularly, the present invention relates to such an article of manufacture made from marbleized thermoplastic material to simulate the grain of natural ivory with the marbleized thermoplastic material having coloristic properties and translucency to simulate a natural ivory key cover.

It is known in the art to adhere a rigid key cover plate of synthetic resin to the outer exposed ends of wooden, hammer-actuated linkages for contact by the fingers of a person playing the piano. The same type of key covers are attached to the keys of an organ or similar instruments. The cover plates are provided on new instruments and they may be replaced from time-to-time as required, for example, due to wear or damage due to abuse, failure of the adhesive and accidents. The synthetic resin must be accurately sized as to length, width and thickness before it is adhered to the surface of the key. After an existing key cover is removed, a coating of adhesive is applied to the surface of the key and/or cover to form a strong and essentially permanent bond between the cover plate and the key by positioning the cover on the key surface under moderate pressure.

It was a well accepted practice in the past to adhere cover plates fashioned from ivory to the keys of pianos and organs. Ivory not only provided well accepted aesthetic appearance but also was well suited because the exposed surface when contacted by the player's fingers was not affected by moisture and resisted wear, scratching and other mechanical abuse. Typically, an oversized cover fashioned from ivory was attached by glue to a key and then after the glue had set, the cover was reduced to the proper dimensions. However, the covers aged and yellowed to the point where it was necessary to remove and replace all the covers for the instrument. The replacement of a cover for one or more of the keys or even all the keys of an instrument is unduly expensive because of the skilled labor which is required and also because of the scarcity of ivory. After the ivory is sliced to the desired thickness, usually about 0.040 inch, the slabs of ivory are bleached to a uniform coloration. The bleached slabs of ivory typically have a translucency which necessitated the use of a white cover coat on the wooden surface of the keys to mask their natural wood-grain coloration. The white cover coat and translucent property of the ivory enhanced the aesthetic appearance of covered keys, which includes an added dimension of perceived depth.

SUMMARY OF THE INVENTION

It is an object of the present invention to closely match the aesthetic appearance including the translucency of ivory key covers through the use of a plastic material having coloristic properties to closely match the color and grain properties of ivory.

It is, therefore, an object of the present invention to provide a key cover plate made of plastic material for a piano or the like having translucent properties and grain to simulate and closely match ivory as heretofore used for key covers.

More particularly, according to the present invention there is provided a key cover comprised of injection-molded thermoplastic material and marbleized by incomplete mixing of a color agent to simulate the grain of natural ivory, the marbleized thermoplastic material having a Munsell hue of 8.8Y to 6.6YR, a Munsell value of 8.3 to 9.3, a Munsell chroma of between 1.0 to 2.6 and a contrast ratio of between 70 to 90.

These features and advantages of the present invention as well as others will be more fully understood when the following description is read in light of the accompanying drawings, in which.

Figure 1:
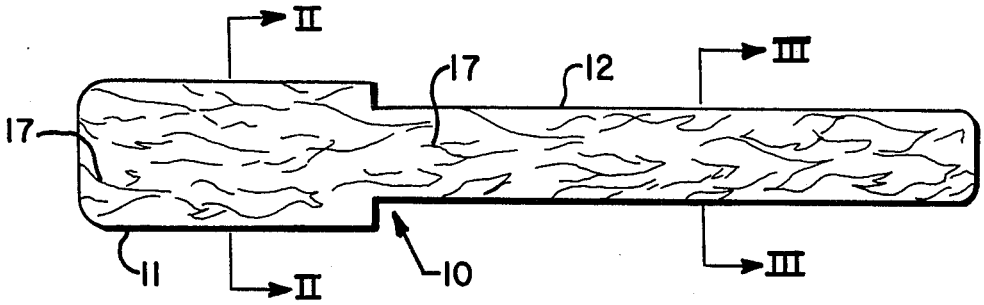
FIG. 1 is a plan view of a piano key cover plate having a well-known configuration and made of thermoplastic material according to the present invention.
Figure 2:
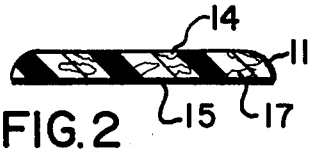
FIG. 2 is a sectional view taken along line II—II of FIG. 1.
Figure 3:
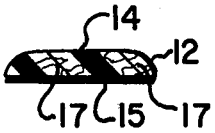
FIG. 3 is a sectional view taken along line III—III of FIG. 1.

In FIGS. 1–3, there is illustrated a "D" piano key cover. The cover is identified by reference numeral 10 and includes a head 11 and a tail 12 joined to the forepart centrally thereof. As is well known in the art, key covers for B, C, E, F and other keys of a piano have a head and tail joined thereto so that one of the lateral sides is continuous. The key cover 10 has planar top and bottom surfaces 14 and 15, respectively, extending to a radius along the side edges. Preferably, the thickness of the key cover is about 0.070 inch and graining is randomly dispersed in the longitudinal direction along the shank and forepart. Swirls and lateral graining randomly occur in key covers of the present invention because of the injection-molding process. This enhances a simulation of graining in natural ivory material. The graining is indicated by irregular patches identified by reference numeral 17 in FIGS. 1–3.

Figure 4:
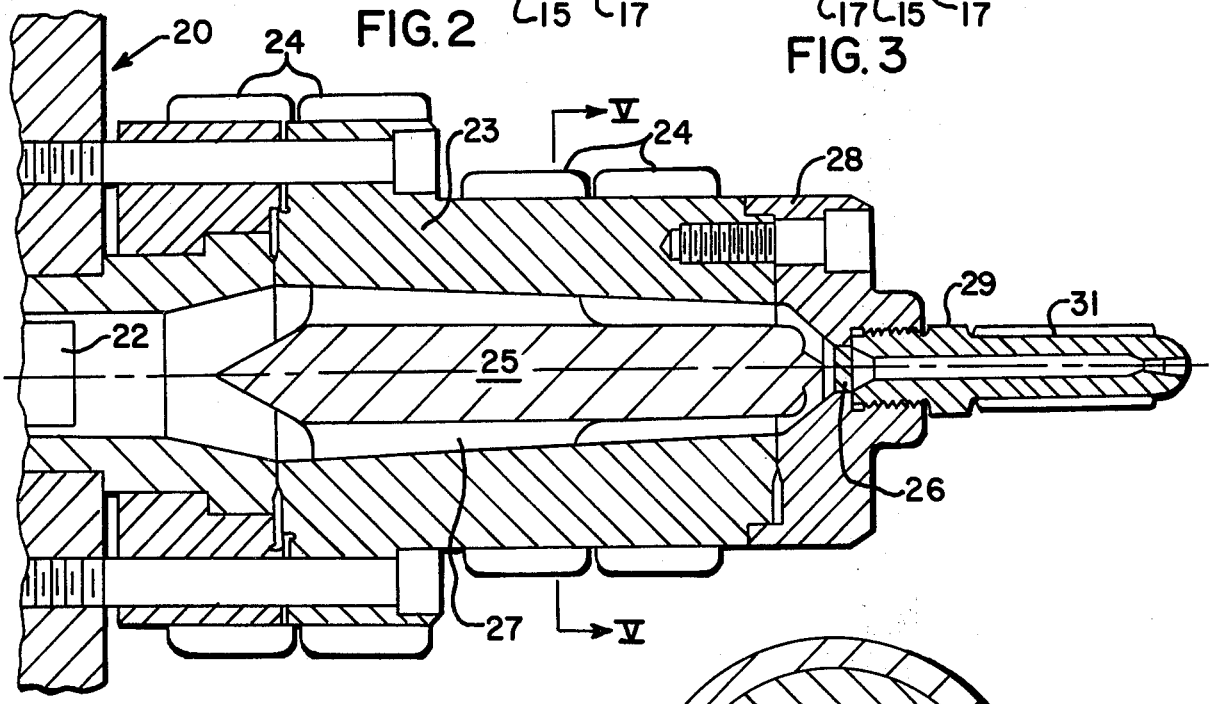
FIG. 4 is an elevational view, in section, through part of an injection-molding machine which is suitable for producing the key covers of the present invention.
Figure 5:
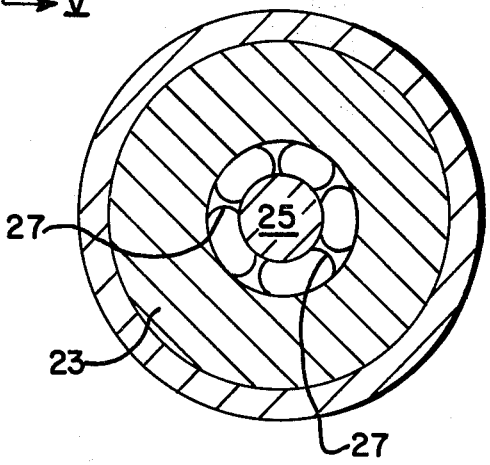
FIG. 5 is a sectional view taken along line V—V of FIG. 4.

Manufacture of the key covers according to the present invention is carried out by an injection-molding process using thermoplastic material such as styrene, particularly impact styrene, acrylic or polycarbonate. Such materials are in pellet or granular form when loaded into the hopper of an injection-molding machine together with a color agent. The selection of the color agent must have a hue closely matching the hue of natural ivory as a standard color reference. Ivory and even bleached ivory slabs used for key covers will vary when used as a standard color reference. It has been found that an aesthetically-acceptable range of hue is between 8.8Y to 6.6YR. This corresponds to a dominant wavelength of 572.5 nm to 582.5 nm. The preferred hue is 4.5Y. This corresponds to a dominant wavelength of about 575.5 nm. To match this hue, one color agent which uses an unknown formula and is commercially available consists of a mixture of titanium dioxide and a small amount of cadmium lithopone. To obtain the particular grain effect, there is an absence of a dispersing agent in the formula. One satisfactory color agent is identified as No. K-4799-10, manufactured by General Color & Chemical Company, Inc., Minerva, Ohio. The thermoplastic material is impact polystyrene. The impact on crystal polystrene is mixed with a color agent in a drum for about ½ hour before being loaded into the hopper of the injection-molding machine. A screw-type or hydraulically-operated, plunger-type injection-molding machine can be used, although it is preferred to use the latter since the flow of thermoplastic material through the machine is less turbulent, thereby providing a better marbleizing product due to incomplete mixing of the color agent with a thermoplastic material. Well known forms of injection-molding machines can be used and FIG. 4 illustrates an injection-molding machine 20 having a hydraulically-operated piston and cylinder assembly, not shown, coupled to a piston 22 used to advance the mixture of the color agent and thermoplastic material along a cavity in a barrel 23. Induction heaters 24 are spaced along the barrel to heat the resin. A torpedo spreader 25 is positioned in the cavity of the barrel 23 to extend to a point just short of a dispersion plate 26. The spreader 25, as shown in FIGS. 4 and 5, includes radially-extending webs 27 that engage the cavity surface of the barrel to hold the spreader in place. An end cap 28 is attached by bolts to the end of the barrel. The end cap has a threaded portion that receives a nozzle 29 for delivering the mixture of thermoplastic material and color agent to a mold, not shown. A dispersion plate 30 is supported by the nozzle but removed therefrom during the actual molding of key covers. The mold is of well-known design and is divided so that it can be closed during the injection-molding operation and opened to remove the molded piano key cover. An induction heater 31 is carried on the nozzle. Some mixing of the color agent with the thermoplastic material does occur during the movement of the mixture during heating and movement along the molding machine into the mold. However, mixing is minimized by restricting movement of the mixture to substantially only linear movement whereby marbleizing of the liquefied thermoplastic material and color agent provides the desired graining of the molded piano key cover.

The following Table I contains comparative test results of a plastic key cover according to the present invention, a preferred standard bleached natural ivory key cover, a yellow plastic key cover and a white plastic key cover:

TABLE I

TRISTIMULUS VALUES
1931 (2°) Observer Illuminant C

| Specimen | x | y | Y | λ |
|---|---|---|---|---|
| Ivory Plastic | .3329 | .3434 | 76.96 | 575.5 |
| Ivory Plastic | .3338 | .3449 | 74.92 | 575.0 |
| Natural Ivory | .3449 | .3525 | 68.38 | 577.0 |
| Natural Ivory | .3403 | .3481 | 67.34 | 577.0 |
| Yellow Plastic | .3576 | .3675 | 72.35 | 567.6 |
| White Plastic | .3156 | .3241 | 89.50 | 572.0 |

MUNSELL VALUES CORRESPONDING TO THE TRISTIMULUS VALUES

| Specimen | Hue | V | C |
|---|---|---|---|
| Ivory Plastic | 4.38Y | 8.92 | 1.62 |
| Ivory Plastic | 4.69Y | 8.82 | 1.69 |
| Natural Ivory | 2.32Y | 8.50 | 2.38 |
| Natural Ivory | 2.40Y | 8.45 | 2.03 |
| Yellow Plastic | 2.99Y | 8.70 | 3.40 |
| White Plastic | 8.25Y | 9.47 | 0.43 |

In Table I, λ is the dominant wavelength in the CIE Color Notation System based on a 1931 adoption of a 2° observer or field of vision. The tristimulus values x, y and Y are used for computation according to well-known formulae to derive Munsell figures for Hue, value (V) and chroma (C). The Munsell values can be obtained directly by a color comparison with a set of colored chips. The Munsell system has a linear change variation characteristic and was, therefore, selected to delineate critical color properties and variations thereof to the plastic ivory key cover of the present invention. The CIE and Munsell values are given in Table I for the ivory plastic of the present invention and bleached natural ivory material as well as yellow and white plastic material specimens. The yellow and white plastic material specimens are unacceptable and fall outside the scope of the present invention.

Figure 6:
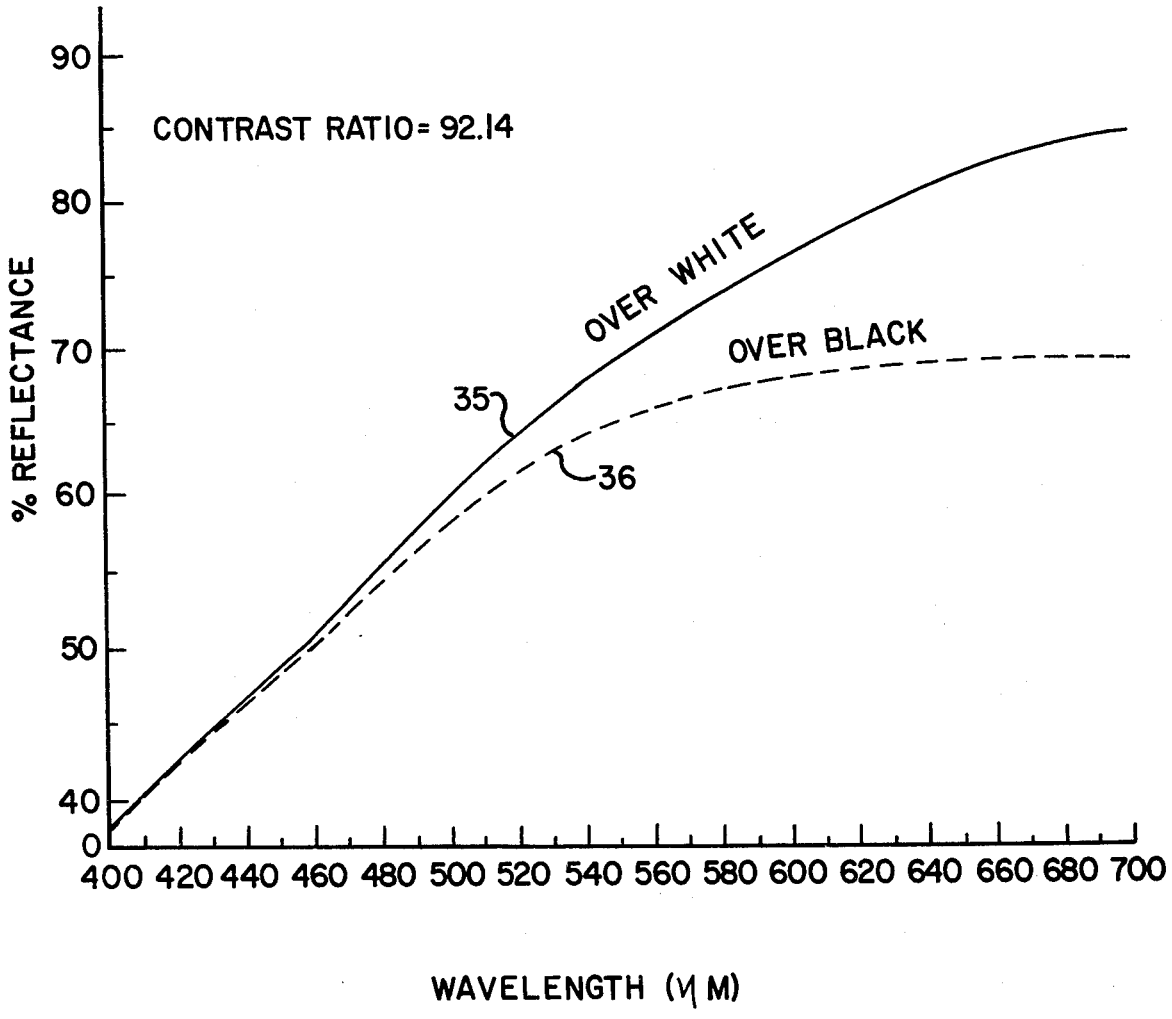
FIGS. 6 and 7 are spectrophotometric curves showing the reflectance over the visible wavelength of key covers made from ivory and from plastic in accordance with the present invention.

The contrast ratio for the ivory plastic key cover specimen from Table I is 80.5. This compares favorably to the contrast ratio of 92.1 for the natural ivory key covers. The contrast ratios are determined by calculations using spectral reflectance curves in the region of 400–700 nanometers as typically shown in FIGS. 6 and 7. The reflectance measurements to develop the curves were taken with key covers of 0.070 inch thickness mounted over a white substrate of 99% reflectance and over a black substrate with 0% reflectance. The contrast ratio was calculated using the expression:

$$Y_B/Y_W \times 100$$

where:

$Y_B$ is the luminous reflectance over a black substrate; and $Y_W$ is the luminous reflectance over a white substrate.

The contrast ratio measurements were taken with no optical seal between the specimen and the black or white substrate. The Y tristimulus value (1931 (2°) observer, illuminant C) is used herein. The thickness of the ivory plastic was 0.07 inch and two pieces of natural ivory were pressed together without an optical seal between them during the measurement of the contrast ratio to achieve a thickness of about 0.075 inch.

Figure 7:
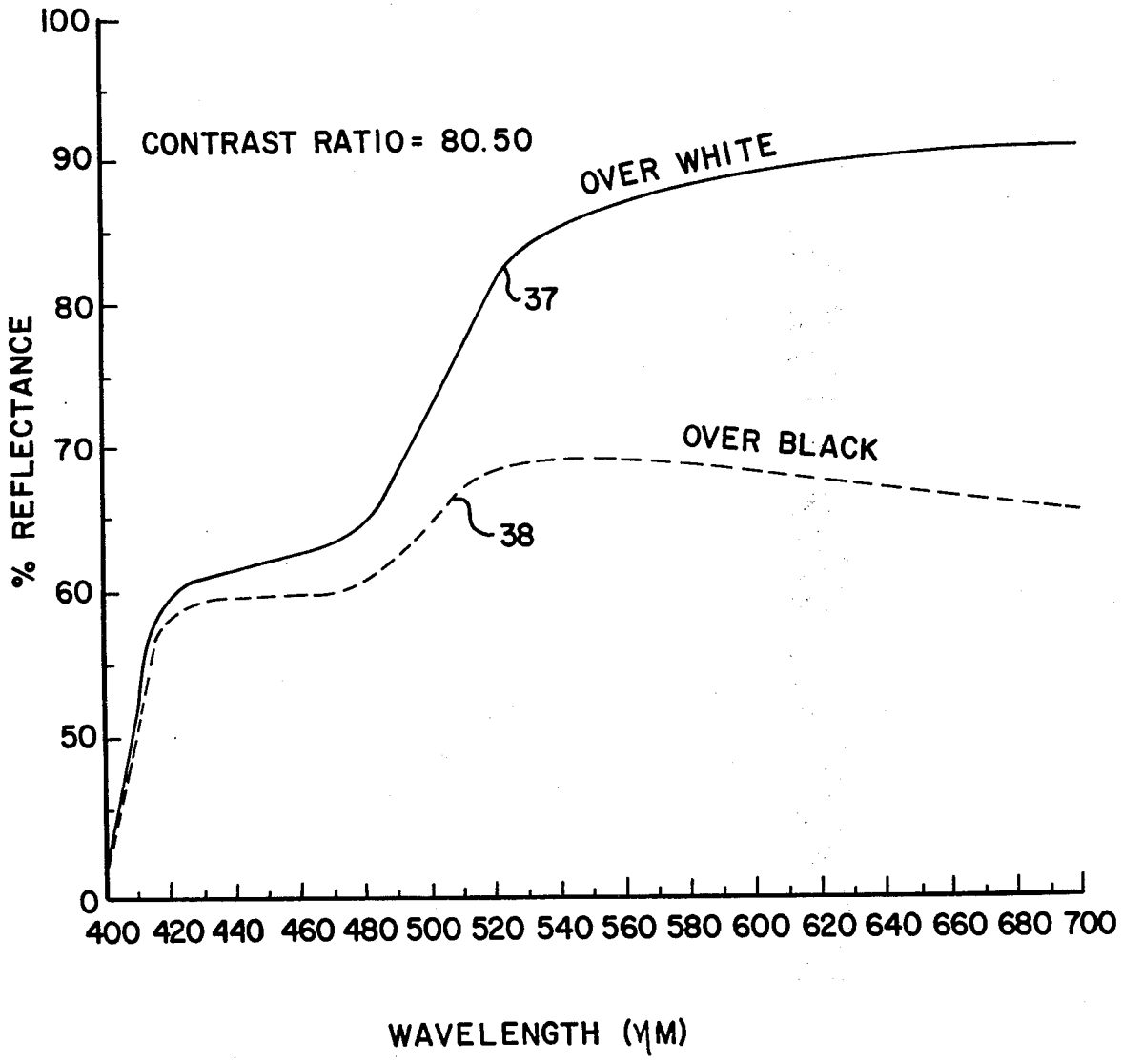

The total reflectance curve of the ivory samples over white is identified by reference numeral 35 and the total reflectance curve of the ivory samples over black is identified by reference numeral 36. The abscissa covers the spectrum of monochromatic light between 400 and 700 nanometers and the ordnate is the reflectance in percent. Calculating the contrast ratios from these curves gives 92.14%. It is to be understood, of course, that the color properties of natural ivory, even after bleaching, vary from piece-to-piece. The same comparison and geometry were used for the graph lines of FIG. 7 as the graph lines of FIG. 6. In FIG. 7, reference numeral 37 identifies the reflectance curve of the specimen over white and reference numeral 38 identifies the reflectance curve of the specimen over black. Computing the contrast ratio over the spectral response gives 80.50%.

It has been found that aesthetically-acceptable ivory plastic key covers simulating the hue of natural ivory fall within the tolerances given in Table II below:

TABLE II

| | | |
|---|---|---|
| Δ λ | = | −3nm to +7nm |
| Hue | = | 8.84Y to 6.55YR |
| V | = | 8.3 to 9.3 |
| C | = | 1.0 to 2.6 |

Δ λ represents the change of the dominant wavelength from 575.5. A hue in the Munsell system of 4.5Y (575.5 nm CIE) to 8.8Y (572.5 nm CIE) is a progression toward greener and and extending this hue to 6.6Y (582.5 nm CIE) is a progression toward redder. (An acceptable range for hue must fall within the range from 4.5Y (CIE dominant wavelength approximately 575.5 nm namometers) to 8.8Y (CIE dominant wavelength approximately 572.5 namometers) to 6.6Y (CIE dominant wavelength approximately 582.5 namometers). The Munsell value is 8.92 with a range of plus 0.4 to minus 0.6. The tolerance to the Munsell chroma at 1.65 is plus 0.9 to minus 0.6. The contrast ratio is preferably at 80 but can be as low as 70 but not higher than 90.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. A key cover plate for pianos and the like comprising injection-molded thermoplastic material marbleized by incomplete mixing of a color agent to simulate the grain of natural ivory, the marbleized thermoplastic material having a Munsell hue of between 8.8Y to 6.6YR, a Munsell chroma of between 1.0 to 2.6, a Munsell value of between 8.3 and 9.3 and a contrast ratio of between 70 and 90.

2. The key cover plate according to claim 1 wherein said marbleized thermoplastic material has a Munsell chroma of 1.65.

3. The key cover plate according to claim 1 wherein said marbleized thermoplastic material has a Munsell value of 8.92.

4. The key cover plate according to claim 1 wherein said color agent comprises a mixture of titanium dioxide and cadmium lithopone.

5. The key cover plate according to claim 1 or 4 wherein said thermoplastic material comprises polystyrene.

6. The key cover plate according to claim 1 wherein said contrast ratio is 80.

7. The key cover according to claim 1 wherein said marbleized thermoplastic material has a Munsell hue of 4.5Y.

* * * * *